United States Patent [19]

Janssen et al.

[11] 4,209,322

[45] Jun. 24, 1980

[54] METHOD FOR PROCESSING DUST-LIKE MATTER FROM METALLURGICAL WASTE GASES

[75] Inventors: Wilhelm Janssen, Mülheim; Karl-Heinrich Vopel; Günter Meyer, both of Essen, all of Fed. Rep. of Germany

[73] Assignee: Fried. Krupp Gesellschaft mit beschränkter Haftung, Essen, Fed. Rep. of Germany

[21] Appl. No.: 681,510

[22] Filed: Apr. 29, 1976

[30] Foreign Application Priority Data

May 3, 1975 [DE] Fed. Rep. of Germany ..... 2519810

[51] Int. Cl.[2] ..... C21B 13/08

[52] U.S. Cl. ..... 75/25; 75/3; 75/33

[58] Field of Search ..... 75/3, 4, 5, 29, 33, 75/36, 25, 34, 35; 23/313 P

[56] References Cited

U.S. PATENT DOCUMENTS 3,219,436 11/1965 Heitmann et al. ..... 75/34

3,403,018 9/1968 Thom ..... 75/25

FOREIGN PATENT DOCUMENTS 942268 4/1956 Fed. Rep. of Germany .

1026769 3/1958 Fed. Rep. of Germany .

1608298 12/1970 Fed. Rep. of Germany .

1508050 8/1971 Fed. Rep. of Germany .

2253590 5/1973 Fed. Rep. of Germany .

2348287 5/1974 Fed. Rep. of Germany .

2300889 7/1974 Fed. Rep. of Germany .

46-15207 4/1971 Japan ..... 75/25

*Primary Examiner*—L. Dewayne Rutledge

*Assistant Examiner*—Michael L. Lewis

*Attorney, Agent, or Firm*—Spencer & Kaye

[57] ABSTRACT

A method is provided for processing dusts and muds from dust removing systems in the iron and steel industry by pelletizing them for further processing. Green pellets are formed by pelletizing the dusts and/or muds with a moisture content of between 10% and 16% for less than 6 minutes with an addition of water such that the moisture content of the green pellets is between 17% and 30%. The green pellets, together with a reducing agent, are then introduced into a rotary furnace.

7 Claims, No Drawings

METHOD FOR PROCESSING DUST-LIKE MATTER FROM METALLURGICAL WASTE GASES

BACKGROUND OF THE INVENTION

The present invention relates to a method for processing dusts and muds from dust removing plants in the iron and steel industry where the dusts are pelletized for further processing.

During the dust removal from waste gases of metallurgical plants, such as blast furnaces, converters, electrofurnaces and sintering plants, a large quantity of dust-like matter is produced which should be dressed and further processed, particularly due to its considerable iron content.

Dust-like matter may develop, depending on the type of dust removal process employed, either in dry dust removal plants as a dry dust, or in wet dust removal plants as a water-dust dispersion. The water-dust dispersion can be concentrated in such a manner that a mud is deposited from the dispersion in a thickener while clear water flows out through an overflow of the thickener.

In the production of raw iron, 5 to 20 kg dust are developed in blast furnace dust removal plants per ton of raw iron. In the production of steel in LD converters, 18 to 21 kg dust are developed per ton of steel. The exact quantities of dust developed depend on the size of the metallurgical plant, the raw materials employed, and the mode of operation involved.

The use of dusts and muds in sintering systems is very limited due to the very fine consistency of the solid matter and due to the varying contents of zinc, lead and alkalis which have an adverse influence on blast furnace operation. Dumping of such substances is sometimes also not possible due to environmental protection laws.

Due to the relatively high iron, zinc and lead contents, these substances are dressed and processed either as dry dust, mud or a mixture of the two. One prior proposal for treating the dust material provides for pelletizing the dust material together with iron ore concentrate to form green pellets. The green pellets are then prehardended on a traveling grate and thereafter are reduced in a series-connected cylindrical rotary kiln with the addition of solid fuels whereby zinc and lead volatilize. The resulting products are metallized pellets containing relatively small quantities of zinc and lead. These metallized pellets, however, have a relatively high sulfur content so that use thereof is possible mainly in blast furnaces. There further exists the danger of the green pellets sintering together on the traveling grate since carbon is always present in the blast furnace dusts. To avoid such sintering together, it is necessary, in the above-mentioned processes, to add relatively large quantities of fine ore as a leaning material to the mixture which is formed into the green pellets, or to prevent that oxigen may enter into the grate area.

In the past, binders, such as bentonite, calcium hydroxide, starch, limestone, and other similar materials, have been used in the production of pellets. In addition, oil and pitch have been used as binders.

SUMMARY OF THE INVENTION

It is a primary object of the present invention to provide a process which avoids the above-mentioned drawbacks, i.e., which operates without a traveling grate in the processing of mixtures of dry dusts and/or muds and permits the production of metallized pellets which are substantially free of zinc, lead and alkalis.

A further object of the present invention is to provide a process for producing pellets without the use of binders.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects, and in accordance with its purposes, the present invention, as embodied and broadly described, provides a method for processing dusts and muds from dust removal plants in the iron and steel industry where the dusts and muds are pelletized for further processing. The method comprises: forming green pellets by pelletizing the dust material with a moisture content of 10 to 16 weight-% for less than 6 minutes with the addition of water only such that the moisture content of the green pellets is between 17 to 30 weight-%; and introducing the green pellets—together with a reducing agent—directly into a rotary kiln to reduce the green pellets.

In the practice of the present invention, no addition of any kind of binder or ore or ore concentrate is required.

DETAILED DESCRIPTION OF THE INVENTION

In the practice of the present invention, the dust material to be pelletized can be the dry dust resulting from dry dust removal plants or the mud resulting from the wet dust removal plants, or a mixture of the dry dusts and muds.

Before pelletization, the dust material to be pelletized comprising dry dusts and/or muds is homogenized, moistened, and respectively dried to a residual moisture of 10 to 16 weight-%. If the pelletization is based on moisture contents in the material to be pelletized of less than 8 weight-%, the resulting green pellets will be very dense due to the very fine consistency of the dusts which have a specific surface according to Blaine of 5,000 to 12,000 $cm^2/g$ and such pellets must be dried very carefully in order to avoid dry cracks and bursting. This requires drying times of 20 to 40 minutes. Accordingly, care is taken in the practice of the present invention to provide in the material to be pelletized a moisture content of 10 to 16%.

A further significant feature of the present invention is that the period of dwell of the material to be pelletized on the pelletizer must be less than 6 minutes, and preferably, is between 3 and 5 minutes. If the period of dwell is longer, the pellets will become so moist at the surface due to water squeezed out that they become superplastic or turn into mud.

Finally, in the present invention, the moisture content of the green pellets must be controlled to be at 17 to 30 weight-%, preferably 18 to 25 weight-%. This moisture content of the green pellets is obtained by controlling the dwell time and amount of water added to the pelletizer. This moisture content has the advantage that these green pellets need neither be dried nor prehardened, but can be introduced directly into a cylindrical rotary furnace together with a reducing agent. The solid reducing agents or fuels that can be used include anthracite, coke fines, low-temperature coke and/or highly volatile coal, e.g., soft coal. The green pellets contain oxidized material, such as metal oxides of iron, zinc and lead, which are reduced during passage through the rotary furnace.

According to a preferred embodiment of the invention, the green pellets are introduced into a cylindrical rotary furnace which has a drying and preheating zone and are heated in the rotary kiln to a temperature of between 900° and 1,100° C. The temperature profile in the rotary kiln can be set via air nozzles distributed over the length of the kiln so that advisably two-thirds of the length of the furnace has a temperature of between 900° and 1,100° C. In this case, the first third of the furnace serves as a drying and preheating zone for the charge of green pellets and the solid reducing fuels.

Operation at the above-mentioned operating temperatures is required for the reduction of iron, zinc and lead oxides and alkali carbonates that are in the green pellets. Zinc and lead then will leave the charge in the form of metal vapor, re-oxidize in the free kiln room and leave the furnace in solid form together with the waste gas. These oxides are advantageously collected in a bag filter of electrofilter.

The alkalis carbonates in the pellets are reduced during passage through the rotary kiln too. The volatilization of the alkalis mainly occurs in the form of metal vapor which recarbonates in the free kiln room. Potassium volatilization starts at about 780° C., whereas sodium volatilization does not begin until about 880° C.

The reduced metallized pellets are discharged from the rotary furnace in the form of sponge iron together with the excess fuel and ashes. This mixture is cooled in a cooling drum and dressed by sifting and magnetic separation.

The following example is given by way of illustration to further explain the principles of the invention. This example is merely illustrative and is not to be understood as limiting the scope and underlying principles of the invention in any way. All percentages referred to herein are by weight unless otherwise indicated.

A mixture of 60% predried LD mud and 40% predried shaft furnace mud is homogenized. This mixture has a moisture content of 12%. The most important components of the mixture are:

$Fe_{total}$=42.2%
Zn=5.3%
Pb=1.61%
$Na_2O$=0.8%
$K_2O$=0.35%, and
C=5.8%

The above mixture is introduced into a pelletizer containing a pelletizing plate having a diameter of 1 m. Green pellets with a grain diameter between 8 and 20 mm are produced with the addition of water. These green pellets have a moisture content of 22.7%, a green strength of 2 kp/pellet, and an impact strength such that they can survive more than 20 falls from a height of 450 mm without forming cracks.

The green pellets, together with coke fines of a grain size up to 3 mm as the reduction fuel, are continuously charged directly into a rotary furnace. The rotary furnace is heated from the discharge end with coke furnace gas in countercurrent with respect to the flow of charged material. Over two-thirds of the length of the furnace, the temperatures of the material being treated are between 900° and 1,100° C. so that the alkalis will substantially volatilize.

For a specific throughput of 0.64 t of green pellets/$m^3$ of furnace area and per day, the degree of metallization is an average of 93%. The zinc and lead volatilization lies at 99%. Average zinc contents of 0.055% and lead contents of 0.008% are realized in the metallized pellets. The volatilization of alkalis, with respect to the amount of material charged, is about 80% for sodium oxide and up to 95% for potassium oxide.

The proportion of fine sponge iron of a size <4 mm is only 20%. An oxide with the following analysis is deposited in the bag filter:

Zn=35%
Pb=15%
$Fe_{total}$=15%
$C_{total}$=10%
$Na_2O$=1.1%
$K_2O$=0.7%

This metal oxide can be further enriched either in a zinc-waelz-plant or by wet chemical processes.

It will be understood that the above description of the present invention is susceptible to various modifications, changes and adaptations, and the same are intended to be comprehended within the meaning and range of equivalents of the appended claims.

What is claimed is:

1. A method for processing dust material arising from dust removing systems in the iron and steel industry comprising: forming green pellets by pelletizing the dust material with a moisture content of between 10% and 16% for less than 6 minutes with an addition of water such that the moisture content of the green pellets is between 17% and 30%; and introducing a charge of the green pellets having a moisture content of between 17% and 30% and a reducing agent into a rotary furnace to reduce the green pellets.

2. The method as defined in claim 1, wherein the addition of water is effected in such quantities that the moisture content of the green pellets is between 20% and 25%.

3. The method as defined in claim 1, wherein the charge of green pellets and reducing agent is heated in the rotary furnace, after passing through a preheating zone, to a temperature between 900° and 1,100° C.

4. The method as defined in claim 1, wherein the charge is heated in the rotary furnace over a length of two-thirds of the length of the furnace to a temperature between 900° and 1,100° C.

5. The method as defined in claim 1, wherein the dust material is dust resulting from a dry dust removal plant.

6. The method as defined in claim 1, wherein the dust material is mud resulting from a wet dust removal plant.

7. The method as defined in claim 1, wherein the dust material is a mixture of dust resulting from a dry dust removal plant and mud resulting from a wet dust removal plant.

* * * * *